US007748335B1

(12) United States Patent
Carne

(10) Patent No.: US 7,748,335 B1
(45) Date of Patent: Jul. 6, 2010

(54) METHOD AND APPARATUS FOR WAKE FREE MARINE CRAFT

(76) Inventor: Thomas W. Carne, 60 Lawrence Ave., Portland, ME (US) 04103-2723

( * ) Notice: Subject to any disclaimer, the term of this patent is extended or adjusted under 35 U.S.C. 154(b) by 354 days.

(21) Appl. No.: 11/481,384

(22) Filed: Jul. 5, 2006

(51) Int. Cl.
*B63B 1/00* (2006.01)
*B63B 35/00* (2006.01)
*B63H 25/06* (2006.01)

(52) U.S. Cl. ..... 114/56.1; 114/61.26; 114/61.27; 114/61.32; 114/61.33; 114/39.25; 114/162

(58) Field of Classification Search ..... 114/56.1, 114/39.11, 39.25, 39.32, 61.2, 61.21, 61.26, 114/61.29, 61.3, 61.31–61.33, 62, 63, 162
See application file for complete search history.

(56) References Cited

U.S. PATENT DOCUMENTS

| | | | | | |
|---|---|---|---|---|---|
| 536,070 | A | | 3/1895 | Dubreul | |
| 1,959,523 | A | * | 5/1934 | Chlebowski | 114/43 |
| 2,185,430 | A | | 1/1940 | Burgess | |
| 2,371,478 | A | | 3/1945 | Steele | |
| 2,546,704 | A | | 3/1951 | Sweeny et al. | |
| 2,612,130 | A | * | 9/1952 | Wendt | 114/62 |
| 3,225,729 | A | | 12/1965 | Ewing, Jr. | |
| 3,763,810 | A | * | 10/1973 | Payne | 114/285 |
| 4,649,851 | A | * | 3/1987 | April | 114/271 |
| 4,915,048 | A | * | 4/1990 | Stanford | 114/274 |
| 4,936,237 | A | | 6/1990 | Walters | |
| 5,120,070 | A | * | 6/1992 | Boyden | 280/1 |
| 5,152,238 | A | * | 10/1992 | Page | 114/143 |
| 5,231,946 | A | | 8/1993 | Giles | |
| 6,138,602 | A | * | 10/2000 | Cary | 114/288 |
| 6,158,369 | A | * | 12/2000 | Calderon | 114/56.1 |
| 6,994,049 | B1 | * | 2/2006 | Schulz | 114/274 |
| 2005/0022713 | A1 | | 2/2005 | Reynolds | |

OTHER PUBLICATIONS

Structural Aspects of a High-speed Pentamaran; The Naval Architect, Sep. 2003.
M Ship Co. Specializing in Next Generation Hull Technology.
The Cutting Edge of Yacht Design Today by John Browning.
CBTF Underwater Appendage Package.
Van Gorkom Yacht Design, Volvo Ocean 70.
FastShip Atlantic Inc. Fast Container Ships.
Faster Ships of the Future, Scientific American, Oct. 1997.
Copyright Registration No. DVH 0009, Apr. 17, 2000.

* cited by examiner

*Primary Examiner*—Daniel V Venne
(74) *Attorney, Agent, or Firm*—Stan Jones, Patents

(57) ABSTRACT

The hull design for this invention includes a sharp bow, deep V concave shape ("VC") monohull with a reverse curvature running from a flat straight keel to the upper rail and also encompassing the entire hull length from the bow to the stern. The pointed bow with a bow rudder and a deep flat keel results in a smooth hull for guiding a water column free of a wave and water turbulence to the stern. A mainsail mast and a mizzen shroud slide transversely within limits to promote sail proximity and to achieve increased speed via an improved draft. The mizzen foresail is tacked by moving the mast windward; detaching the mizzen shroud; moving it forward to perform a tacking maneuver, and then moving it aft to a leeward position in relation to the mainsail; and re-attaching the mizzen mast to the moveable traveler.

11 Claims, 7 Drawing Sheets

Bow rudder centered

Bow rudder hard to port

Fig. 7

| ZWL (ft) | Draft (ft) | Dsp (lb) | XCB (ft) | ZCB (ft) | WS (ft^2) | WPA (ft^2) | XCF (ft) | GMT (ft) | GML (ft) | CWP | CP |
|---|---|---|---|---|---|---|---|---|---|---|---|
| -0.50 | 7.57 | 98772 | 44.00 | -3.00 | 1297 | 436.26 | 44.3 | 6.00 | 86.00 | 0.59 | 1.00 |
| -0.42 | 7.65 | 101116 | 43.54 | -2.91 | 1312 | 442.63 | 44.4 | 5.91 | 85.05 | 0.59 | 0.58 |
| -0.33 | 7.73 | 103492 | 43.56 | -2.85 | 1327 | 449.04 | 44.4 | 5.99 | 84.59 | 0.59 | 0.58 |
| -0.25 | 7.82 | 105903 | 43.58 | -2.79 | 1342 | 455.49 | 44.4 | 6.07 | 84.15 | 0.60 | 0.58 |
| -0.17 | 7.90 | 108349 | 43.6 | -2.73 | 1357 | 461.98 | 44.5 | 6.15 | 83.71 | 0.60 | 0.59 |
| -0.08 | 7.98 | 110829 | 43.62 | -2.67 | 1372 | 468.53 | 44.5 | 6.23 | 83.30 | 0.60 | 0.59 |
| 0.00 | 8.07 | 113344 | 43.64 | -2.61 | 1387 | 475.12 | 44.6 | 6.31 | 82.91 | 0.60 | 0.59 |
| 0.08 | 8.15 | 115895 | 43.66 | -2.56 | 1402 | 481.78 | 44.6 | 6.40 | 82.54 | 0.60 | 0.59 |
| 0.17 | 8.23 | 118481 | 43.68 | -2.50 | 1417 | 488.53 | 44.6 | 6.48 | 82.20 | 0.60 | 0.59 |
| 0.25 | 8.32 | 121104 | 43.7 | -2.44 | 1432 | 495.36 | 44.7 | 6.56 | 81.88 | 0.60 | 0.59 |
| 0.33 | 8.40 | 123763 | 43.72 | -2.38 | 1447 | 502.27 | 44.7 | 6.64 | 81.59 | 0.60 | 0.59 |
| 0.42 | 8.48 | 126460 | 43.75 | -2.32 | 1469 | 509.28 | 44.8 | 6.73 | 81.34 | 0.60 | 0.59 |
| 0.50 | 8.57 | 129194 | 43.77 | -2.26 | 1478 | 516.41 | 44.8 | 6.81 | 81.12 | 0.61 | 0.59 |

METHOD AND APPARATUS FOR WAKE FREE MARINE CRAFT

BACKGROUND OF THE INVENTION

This invention is made by a sole inventor without any sponsorship of government funds.

PREVIOUS FILING INFORMATION

This is an original filing of a regular utility patent application.

FIELD OF THE INVENTION

This field of the invention relates generally to marine craft, and more particularly to low resistance hull technology which adds speed and safety for racing. The invention provides an improved passage time and fuel savings in shipping as well. More specifically, the field of this invention relates to a radical departure in hull design together with running rigging, sails, spars, and mast and bow rudder improvements. In short, this invention teaches that many of the rigging connections that are fixed in position for a conventional sail boat are movable for the VC racer. The new hull profile alone—or in combination with the other novel improvements hereof—provides non obvious features well advanced over the known prior art.

EXPLANATION OF TERMS

Set out below are brief descriptions of certain relevant terms which further the understanding of the invention. These terms provide a basis for a detailed teaching of the improvements of this invention in the relevant arts. Such terms are not intended to replace the claims but rather serve as helpful guides in understanding our novel improvements in these arts.

Reverse Curvature.

The hull design for this invention includes a concave or "hollow" shape monohull on a marine craft having a symmetrical deck rail. The hull has a reverse curvature running from a flat straight keel to the deck rail and also encompassing the entire hull length from the bow to the stern of the hull. While a generalized concave hull shape may arguably be known—it is only present is some limited foremost portions of certain prior art hulls.

This invention features a sharp pointed bow and a deep flat keel having a reverse V curvature hull with an area of maximum constriction for guiding a water column along the wetted surface of the craft. This reverse V curvature, covers the hull surface from the flat keel to the rail where the maximum constriction collects water from above and below for movement along the hull free from significant water disruption.

Collection and Dispersion Laminar Flow

The deep VC monohull of the invention differs from conventional hydroplaning approaches in that rather than trying to force water underneath the hull—or spread the water in curled waves away from the hull—this concave hull invention strives to collect the water in a column along a direct line along the entire wetted hull surface. That direct line is below the waterline from bow to stern at an area defined by a series of points of maximum arc constriction.

The term "collection" is the function provided by the reverse or concave VC curvature; while, "dispersion" by "laminar flow" is the function of moving the water, with minimum disturbance, along the entire wetted hull surface with a minimum drag coefficient. The end result is a high speed craft with a deep V monohull exhibiting a reduced drag coefficient that allows the speed and stability limits to be pushed higher than those achieved by the prior art. A reduced amount of fuel consumption and enhanced performance are direct results from this novel invention.

Pinched

"Collection and laminar flow" is my newly introduced technology applying to a hull being concave from the keel to the rail and all other faired surfaces in contact with the water. These concave changes are often referred to in the marine art as "pinched." Pinched as used herein means gradually squeezed down and it will become more readily apparent from further description in connection with certain selected station locations in the Drawing as described further hereinafter.

Hull Characteristics

The inventive keel is flat. A non rocker keel, at first blush, may seem out of place for a high speed racer until one is exposed to the above-mentioned teaching of "collection and laminar flow" wherein the concept for a deep, flat keel VC hull is to avoid water disruption as much as possible. A knife edge bow and stern and keel-to-rail slightly V concave hull surface achieves less disruption in the water than those of the prior art discussed herein.

Bow Rudder

Since my knife edge profile hull design tends to favor straight line movement, I have invented an improved bow rudder with a pivot taking the form of a full draft matching column-and-socket relationship. This bow rudder is located just in front of the hull's most forward watertight bulkhead, and is shaped as though it were a forward portion of the overall hull profile. In a side view the leading edge of my novel bow rudder is kicked back five degrees (almost vertically parallel) to the forward perpendicular of the hull. Port to starboard pivot movements of about 13 degrees each direction (as per FIGS. 6*a* and 6*b*) before reaching a pair of stop shoulders 280, 285 located on either side of column 257, together with an aft rudder, achieves ample steering control for my new hull design. The aft rudder is also full draft and it is located just behind the hull's aft perpendicular.

BACKGROUND

Description of Prior Art

Wakes and water disruption are generally conceded to be the major limiting factors in hull design for marine craft of all types. Concave hull forms for a forward hull portion are arguably known, but they are primarily limited to partial sections of the hull on most marine craft. Sailing ships have generally been characterized by convex surfaces from the handrail to the keel. Also, most hulls have a rocker-shaped keel. The prior art hull designs promote wave movement away from or under the craft and result in extreme water turbulence.

For the above-mentioned reasons, the general direction of the prior art is to turn to various flat bottom approaches directed toward hydroplaning and/or multi hull approaches. A limited prior art search has turned up some art and articles of interest that is listed hereinafter. Copies of such art are submitted herewith.

Certain art known to the inventor by a search includes the following:

| | | |
|---|---|---|
| U.S. Pat. No. 5,231,946 | USPub 2005/0022713 A1 | U.S. Pat. No. 536,070 |
| U.S. Pat. No. 2,612,130 | U.S. Pat. No. 2,185,430 | U.S. Pat. No. 2,371,478 |
| U.S. Pat. No. 2,546,704 | U.S. Pat. No. 3,225,729 | U.S. Pat. No. 4,936,237 |

Structural Aspects of a High-speed Pentamaran; The Naval Architect, September 2003.

M Ship Co. Specializing in Next Generation Hull Technology;

The Cutting Edge of Yacht Design Today by John Browning;

CBTF Underwater Appendage Package;

VanGorkom Yacht Design, Volvo Ocean 70;

FastShip Atlantic Inc. Fast Container Ships.

Faster Ships for the Future, Scientific American, October 1997 Copyright Registration Number DVH 0009, Apr. 17, 2000.

A detailed description of each of the above-noted art/articles is not believed to be warranted. Instead, we shall summarize the above noted patents and publications together as a group. Such art generally teaches the concept of throwing the water away or forcing the water down and under the craft. Prior art wave generating approaches cause the stern to sink and the craft generally moves uphill in the water. Severe waves are created by the structures set out in this art. In one specific reference, waves are deliberately created to try to nullify the inevitable waves associated with these approaches.

In addition, most of the art noted above has either convex and/or multi-hull catamaran or pentamaran type structures. In any event, however, the novel features of the invention are not disclosed or suggested.

In conclusion, what has not yet been provided, in order to fill a long sought for need, is an essentially wave free craft with a hull shape and novel improvements in running rigging, sails, spars, mast and rudder technology. The new hull and the other novel improvements of this invention provide non obvious features well advanced over the known prior art.

SUMMARY OF THE INVENTION

My invention involves a very deep concave V hull of smooth continuous reverse curvature shape. This new and improved hull shape runs the full length from the bow to stern and from a flat keel to the rail symmetrically on both sides of the monohull craft. I refer to my invention as a VC racer. It shows promise, however, to chine and turn of the bilge hulls for larger ships.

My novel hull shape favors a straight line movement pattern. For steering purposes I have provided a bow rudder which is formed as though it were a continuation of the novel hull shape. My bow rudder is pivoted along the extreme forward most portions of the craft and directly in front of the foremost bulkhead. The pivoting bow rudder of the invention swivels within stopped limits either to starboard or port, and is employed, together with a stern rudder, for steering this deep VC sailboat or ship.

Also lying along the longitudinal axis for the craft are a transversely moveable mast base and a moveable mizzen shroud. Both are moveable within limits to promote sail tack changes and to adjust sail proximity relationships between the two sails. Additionally, my mizzen headsail has a boom that reaches all the way back to the aft end of the mainsail boom.

My invention with this extra long mizzen boom is tacked by moving the mast windward and detaching the mizzen shroud. Once detached the shroud and boom are winched sufficiently forward toward the bow that my long mizzen boom will clear the mast. When clear, the mizzen sail is moved leeward to the opposite side of the craft. The mizzen shroud also, like the mast, moves port and starboard to facilitate slot adjustment or sail proximity relationship changes with the mainsail. Such transverse shifts allow this and similar sail changes to take place safely and with a minimum of interruption in sailing maneuvers.

The novel features of the disclosed invention provide many unusual benefits. Achieved by this invention are some of the following features and benefits:

High nautical speed, free from a wake.

Low coefficient hull surface promoting fuel economy.

A V-shaped vortex, rather than a turbulent wave, is created as the VC racer moves in water.

Rigging fixtures fixed in position in conventional craft are moveable in the VC racer invention.

Water is collected as a column at an area of maximum constriction where it moves with a minimum of disruption along the wetted surface of my VC hull.

A reduced hull resistance achieves superior speeds in comparison to the known prior art.

While the prior art has a propensity to "pound" on the water, such pounding is virtually eliminated by my VC racer invention.

A narrow angle turn is achieved easily within a few boat lengths by employing both a full draft bow and a full draft stern rudder.

Simply by increasing the relative proportions, the novel VC racer profile and collection and laminar flow water dispersion may be applied to shipping and other similar marine craft.

Reduction in ballast weight and minor modifications allow the VC racer to fit within so called "Box Rules" for racing classes.

DRAWING

FIG. 1 is a side view of a VC racer in accordance with the invention;

FIG. 2 includes FIGS. 2A and 2B. FIG. 2A shows a top view of the VC racer of FIG. 1 and FIG. 2B is a simplified top view useful in explaining sail tacks and slot or sail proximity relationship changes between the mainsail and mizzen sail;

Figure 6A:
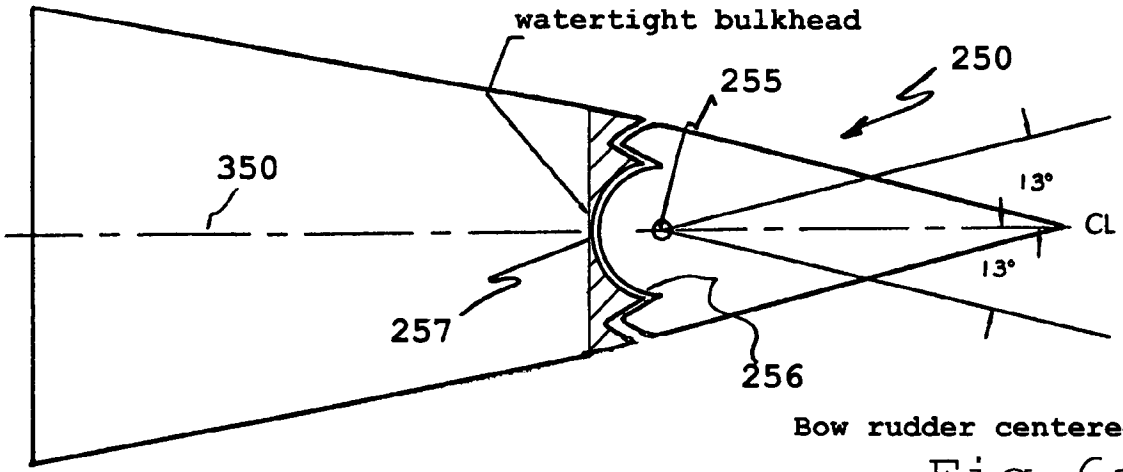
Figure 6B:
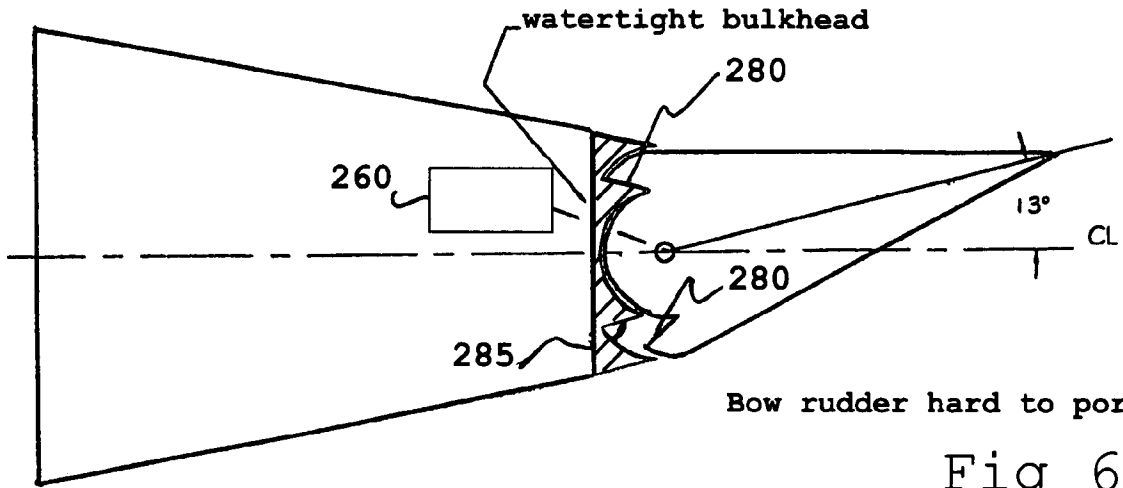
Figure 8:
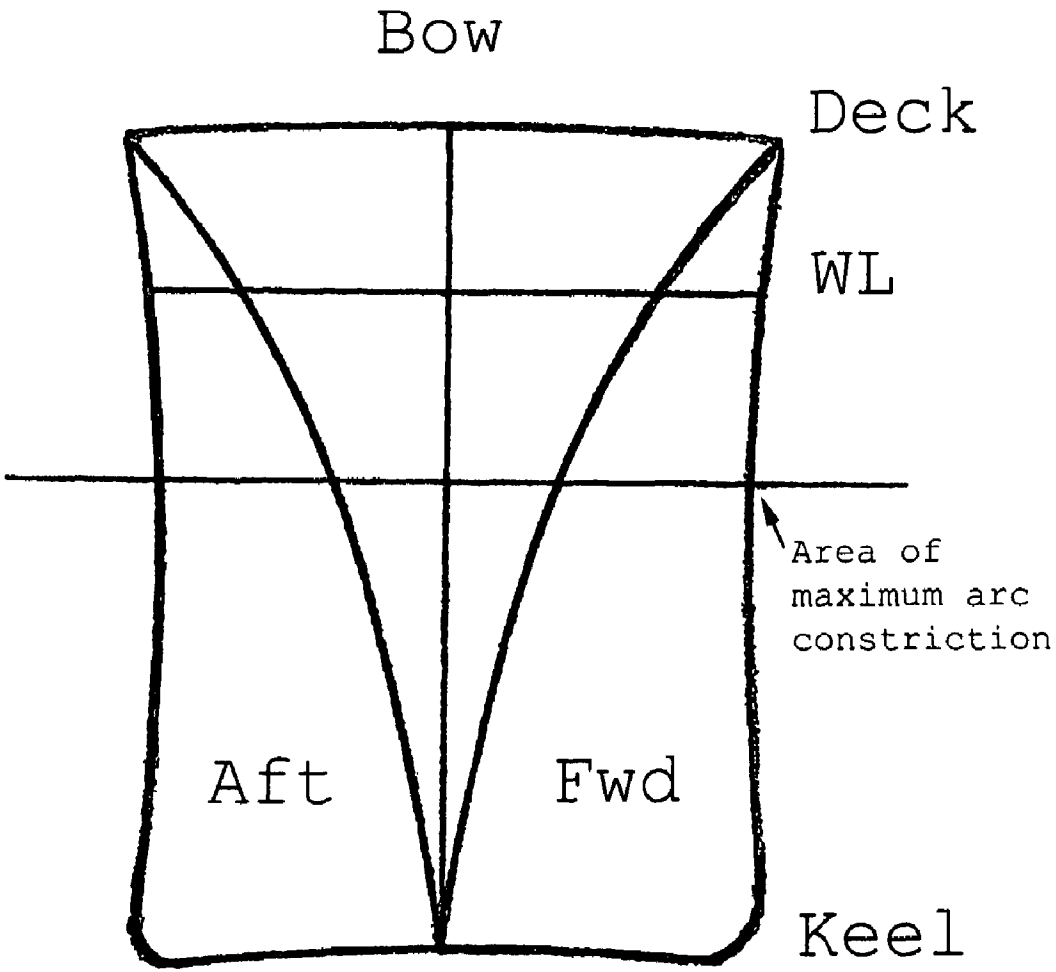

FIG. 6 includes FIGS. 6*a* and 6*b* which depict a top view of my improved bow rudder;

FIG. 7 is a form coefficient chart for an 80 foot VC racer in accordance with my invention; and FIG. 8 is a simplified cross sectional view of the body lines for my invention as applied to a container shipping vessel.

DETAILED DESCRIPTION OF THE PREFERRED EMBODIMENT

Figure 1:
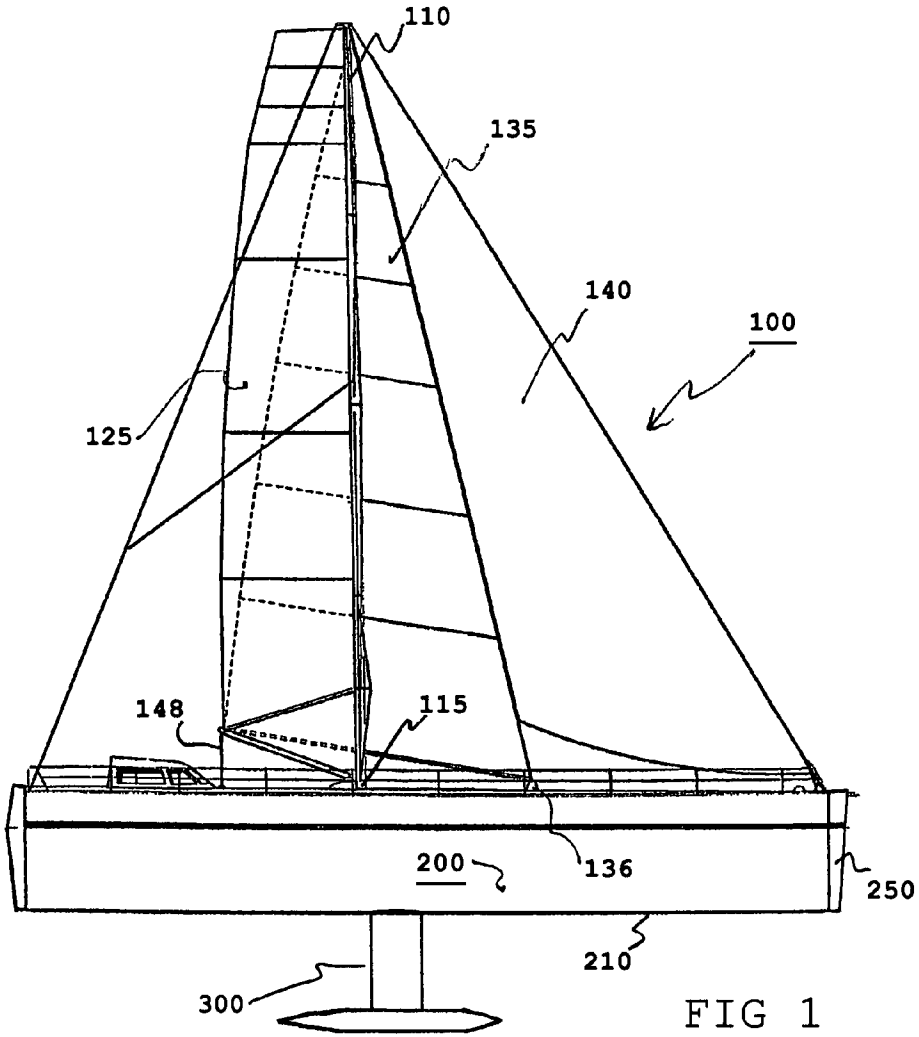

FIG. 1 depicts a side view of a VC racer 100 which is helpful in understanding my rigging spars and mast improvements and shows in broad terms my flat keel 210 and hull 200.

Mast support wires return to the mast 110 instead of the prior art style of being terminated on the deck.

Bulbous ballast 300 may be of any suitable type typically known in the art. In my invention, however, the ballast 300 will likewise be profiled as closely as practical so as to mimic the profile of my improved hull 200. In describing the Figures of my drawing, it is not my intention to flood the reader with nautical marine terms, but rather to set the description in sufficient generality that the novel features of my invention can be understood by those skilled in the marine art and others not so skilled as well.

Turning now to FIG. 1 and focusing on hull 200, please note that my hull shape is flat and straight along the keel 210. Also please note that the bow rudder 250 is a full draft rudder in that it is as deep as the hull 200 and is essentially a forward portion of my hull 200. More will be described about this bow rudder 250 later in conjunction with a detailed description of my FIG. 6.

Mast 110, FIG. 1, is selected to be of the crane type in that is has a stronger column and is understood to be provided with sufficient spreaders and wire members (not shown) for increased stiffness and stability. Such stability members are well known in the art and need not be explained further.

The mainsail is 125 and is flat topped. The mizzen sail 135 is shown with part of the mizzen boom and the leech edge of the mizzen sail dashed since it is hidden behind the mainsail 125. The foresail 140, in this depiction, is about a 70% sail ending abreast the edge of mizzen sail 135. Other foresails are obviously available for my VC racer.

Figure 2A:
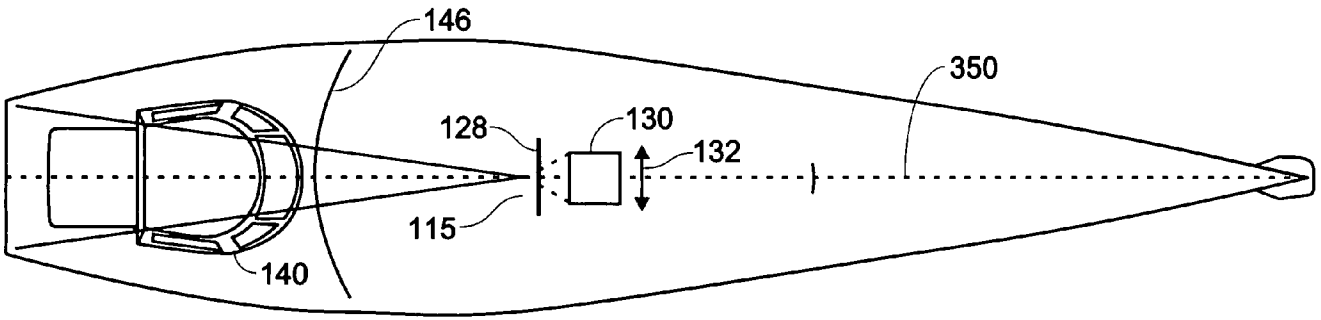

Mast 110—rather than being fixed in position—rides in a traveler 115. Traveler 115 is set upon suitable rails 128, FIG. 2A, so that it and mast 110 may travel transversely port to starboard and visa versa under control of any suitable mover such as, for example, a block and tackle winch assembly 130. This transverse mast movement is representatively indicated in FIG. 2A by the double headed arrow 132. Such travelers 115 and winch assemblies 130 are available from major marine supply houses such as Annapolis Performance Sailing and need not be described further. Just forward of the cabin 140, FIG. 2A, is an arced track 146 for movably retaining the boom control line 148 (main sheet) of FIG. 1.

Figure 2B:
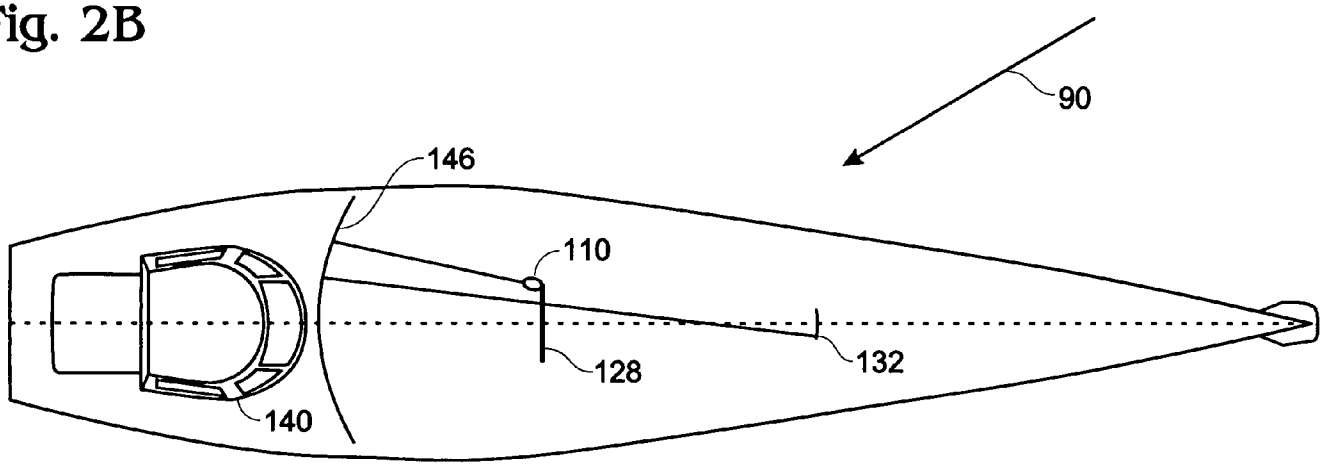

The rigging, sails and spars of FIG. 1, are used in an improved method in accordance with this invention. My method allows a VC racer 100 to sail an extremely narrow angle windward while achieving an adjustable as well as a uniform slot between the mainsail 125 and the mizzen sail 135. FIG. 2B is a modified top view showing how my mast and the boom control line 148 (main sheet of FIG. 1) moves for a sail position change, or tack.

Assume a wind direction as shown by arrow 90, FIG. 2B. This simplified FIG. 2B shows that the mast 110 has moved windward (via movement of traveler 115, FIG. 1) and the mizzen shroud deck traveler 136 has moved leeward. In the well accepted art of winching by known traveler systems, the foot of the mizzen sail boom is detachable from traveler 136 at the deck.

To tack, the mizzen shroud and the mizzen boom are both detached from traveler 136 so that they may move together move forward and up in the air several feet so that the mizzen sail 135 can clear the mast and shift leeward. The mizzen boom to achieve this position shift is restrained fore and aft in a commonly employed string lining maneuver.

Figure 3:
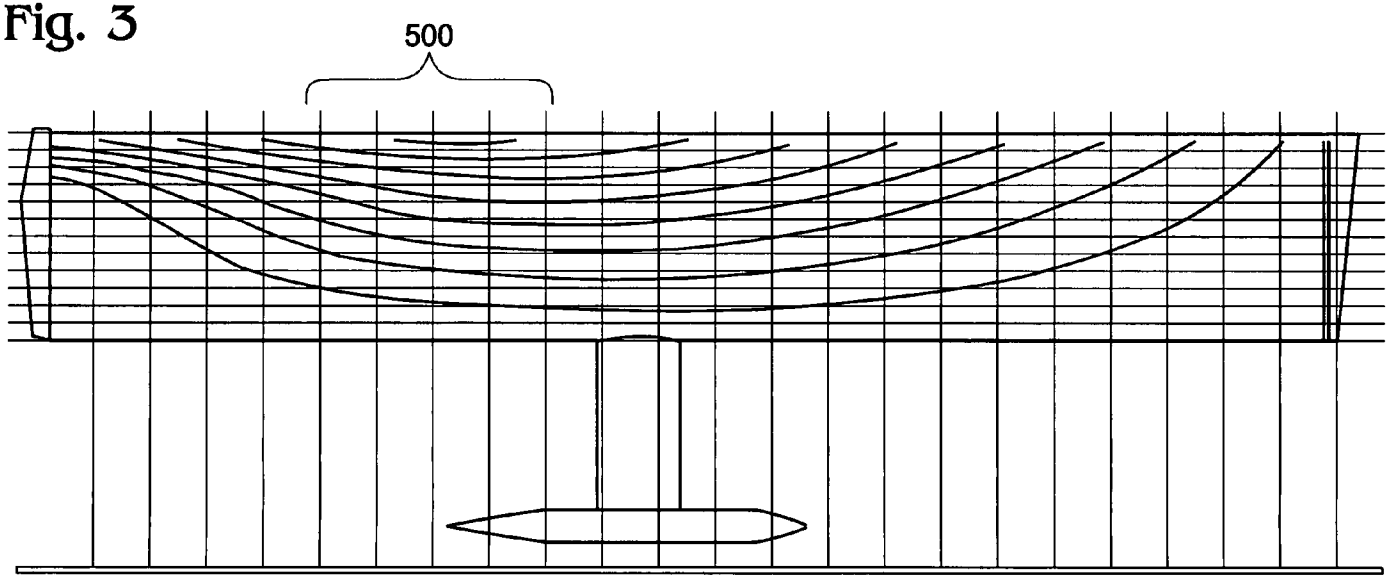
FIG. 3 depicts a side view showing both station and hull contour lines for my VC racer.
Figure 4:
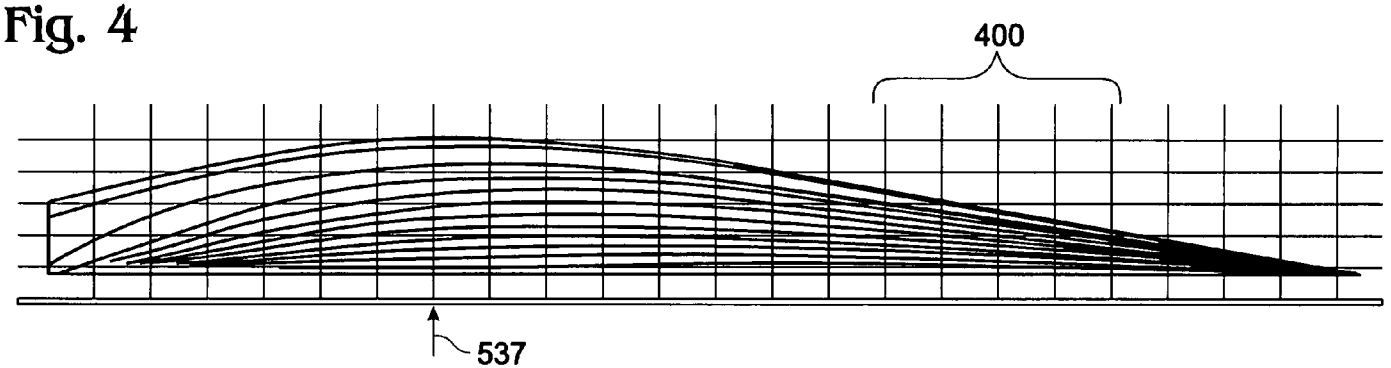
FIG. 4 is a partial top half view of station and hull profile contour lines of FIG. 3.
Figure 5:
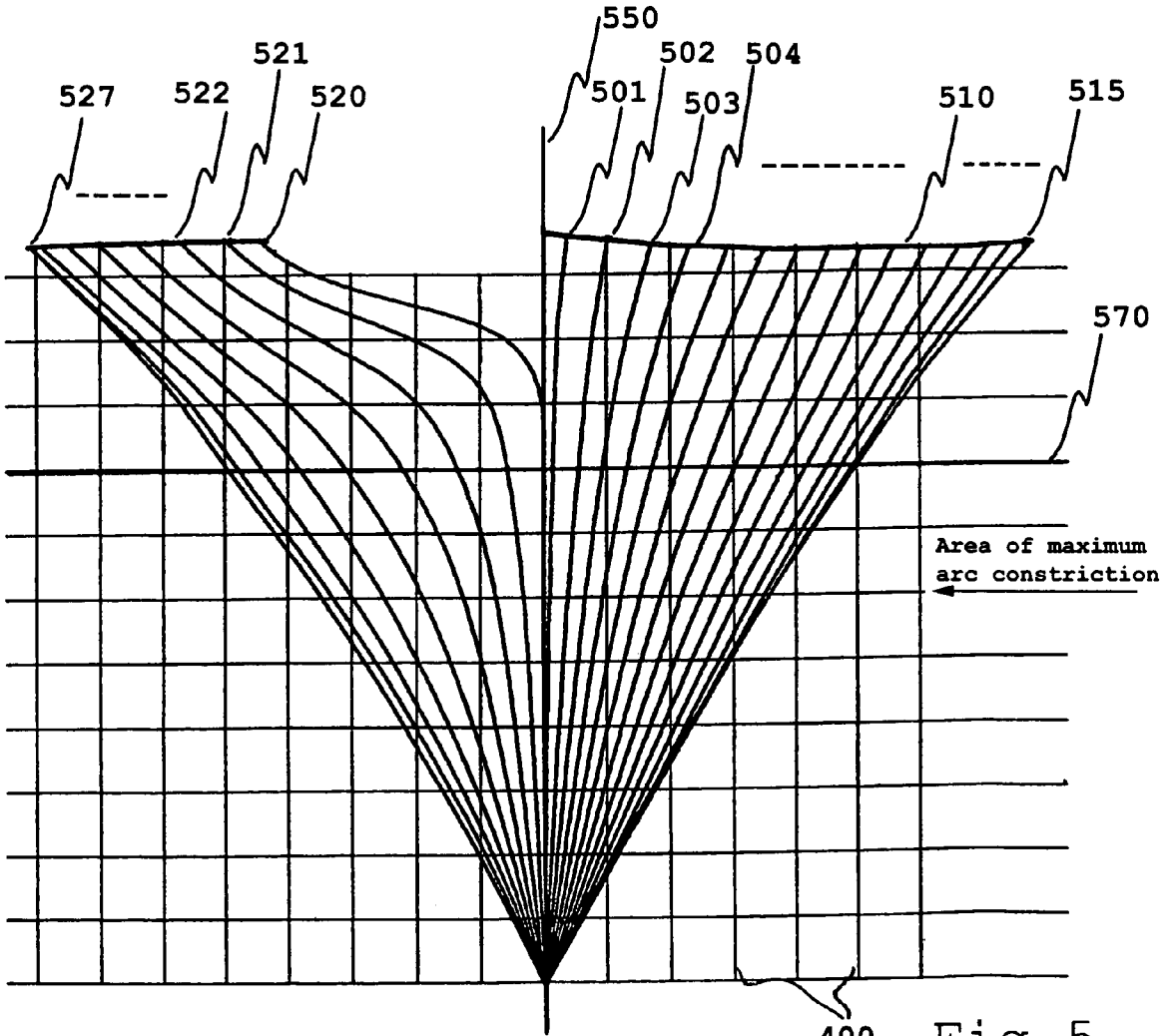
FIG. 5 is a cross sectional view of half breadth body lines, of FIGS. 3 and 4 for my VC racer.

Turning now to FIGS. 3, 4 and 5 my novel hull design is shown as spaced apart contour lines 500 that represent a concave or "hollow" shape monohull with a novel reverse VC curvature. Although shown as a series of soft lines it should be understood that my improved hull surface is smooth and continuous and faired in all directions to avoid creating turbulence in the water when the VC racer is moving.

In the longitudinal views of FIGS. 3 and 4 one sees an equally spaced series of vertical lines 400. It is understood in this art that such vertical station lines 400 and contour lines 500 are taken at intervals along a smooth uninterrupted hull surface 200. These vertical lines 400 are often referred to as station lines as they are useful in the actual layout and construction of a craft.

The same contour lines 500 and station lines 400 of FIGS. 3 and 4 are also shown in my FIG. 5. FIG. 5 includes a prominent vertical axis 550 and a horizontal axis 570. The vertical axis 550 represents the craft vertical, while the horizontal axis 570 represents the designed water line, DWL. The half breadths on the right hand side of FIG. 5 (the bow lines) depict the series of individual contour lines 501, 502, etc. through 515. These lines may be envisioned as though the viewer was at the bow and looking aft to the point of maximum beam width 537 as shown in FIGS. 3 and 4.

The left hand side of FIG. 5 (the stern lines) represents the contour lines 520 through 527 when one is at the aft vertical facing forward and looking toward the bow. Again at maximum beam width 537 such contour lines are hidden from view. The number of body lines for both the right and left hand portions of FIG. 5 are equal to the number of vertical station lines 400 along the longitudinal views of FIGS. 3 and 4.

The reverse curvature of my hull profile is best shown in this FIG. 5 which displays a series of individual contour lines but may best be thought of as repeated cross sectional views taken at various station lines along the entire length of FIGS. 3 and 4. While there is some difficulty of a mathematically precise definition in words alone, the novel hull profile of FIG. 5 differs from the prior art by use of my concave curved profile lines having an area of maximum arc constriction below the craft's water line. Again, I use smooth concave transitions and avoid using any of the straight or convex lines which are so prevalent in the prior art. Moreover, my novel hull shape tends to avoid straight parallel lines, as well, in accordance with the collection and laminar flow dispersion technology for my invention.

Collection and laminar flow is achieved by the FIG. 5 half breadths presentation of a slightly V concave shape profile for both the sharp bow and stern portion of my novel hull. The aft portion of my hull profile (lines 520 through 527) is a reverse slightly concave V shape which blends into a lazy S shape near the transom of my improved hull. The lazy "S" profile lines 520 through 522 are additionally characterized by graduating into an asymptotically approach to the hull aft vertical perpendicular 550 at about ten percent above the water line, WL, at 570.

To the extent that the "S" lines 520 through 522 may be considered partially convex, please note that lines 520 through 522 are near the transom and they are above the water line. Thus, these lazy S line portions 520 through 522 are not in a wetted hull surface.

As noted earlier, the deep V monohull of the invention differs from more conventional wave creating approaches in that rather than trying to force water underneath or away from the hull, this concave hull invention strives to collect the water in a column along the entire wetted hull surface. Lines 501, 502 . . . through 515 in the right hand portion of my FIG. 5 show how such a water column is formed by slightly concave V profile lines. Each line, such as 501, when compared to line 502, 503, etc. differs only slightly and thus major water disruption and turbulence is avoided.

The aligned points of maximum arc constriction are labeled at the approximate location which serves to guide this column of water. This aligned series of points are in a direct line from bow to stern. The maximum arc constriction serves as the water column guide from bow to stern.

I have solved favoritism for straight line travel in the VC racer, by the use of my new improved bow rudder 250. As shown earlier in my FIG. 1, the bow rudder 250 is of the full draft type. FIG. 6 includes top view FIGS. 6*a* and 6*b* wherein the pivot pin 255 for bow rudder 250 is shown just forward of the foremost watertight bulkhead. For straight line travel, rudder 250 is centered on the longitudinal mid ship axis 350. My water tight bulkhead is formed with a number of hemi-cylindrical receiving cups 257 which are spaced and interleave with matching hemi-cylindrical plates that form column 256. Angular movement for bow rudder 250 is achieved by the column and cup relationship of elements 256 and 257.

Also formed in the bulkhead on either side of column 257 are rudder shoulders 280 that limit the amount of pivot travel for the bow rudder 250. These shoulders 280 ride within a pair of matching pie-shaped indents 285 on the bulkhead structure. As an angular steering movement is made under control of unit 260, the bow rudder 250 moves port or starboard as required.

FIG. 6*b* shows a bow rudder 250 moved hard to port about thirteen degrees to turn that direction. Such steering movements may be done by any conventional control such as hydraulic pistons 260, screw and traveler units, or the like.

FIG. 7 sets forth, in table format, the hydrostatic properties for an 80 foot VC racer 100. The table is mostly self explanatory and it has been included merely for sake of completeness. Included in the FIG. 7 table are the various coefficients as labeled by the abbreviated headings along the top of the table. The terms forming the heading of the table have accepted definitions well recognized for this art. Examples include the GMT as shown based upon a predicted vertical center of gravity for one half loads for an 80 foot long VC racer. Other examples include CP—the prismatic coefficient; GM—the position of the longitudinal metacenter, etc. These coefficients are in common use in the ship building art and no further explanation is believed warranted.

FIG. 8 is a simplified view taken in the form as fully described for my FIG. 5. FIG. 8 shows the application of the invention to container shipping vessels. While my earlier Figures and presentation have mostly focused on a sail boat of the VC racer type, please understand that my invention is not so limited. Container ships require high capacity for commercial reasons.

Such container ships have hulls generally characterized by chines on smaller boats and turn of the bilge on larger ships. Again by employing a hull half breadth presentation in accordance with my FIG. 8 the sides, bottom and chine and/or turn of the bilge portions are smooth, continuous and faired with my concave curvature. Improvements in speed together with decreased fuel consumption for such larger vessels are to be expected.

While my invention has been described with reference to particular examples of some preferred embodiments, it is my intention to cover all modifications and equivalents within the scope of the following claims. It is therefore requested that the following claims, which define my invention, be given a liberal interpretation commensurate with my contribution to the relevant technology.

What is claimed is:

1. An essentially wave free monohull marine craft having a longitudinal mid ship axis from bow to stern, a straight deep draft keel and a deck with a symmetrical deck rail on both sides of said craft, said craft being an in water type free from any planing configuration for said hull and characterized by comprising:

a sharp pointed bow and a flat knife edge keel on a deep concave non-planing V hull remaining submersed in water;

said hull having a fully continuous exterior concave and pinched shape with said shape, in cross section, being a slightly concave V curvature symmetrically running from said flat knife edge keel to the deck rail and also encompassing an entire hull length from the bow to the stern;

a bow rudder also shaped with said concave V curvature as though said rudder were a forward continuous portion of said hull; and said craft, when moving in the water, characterized in that said concave V curvature has a maximum arc constriction remaining below a waterline, which constriction collects and guides a water column along a wetted surface of the craft by laminar flow dispersion.

2. The marine craft in accordance with claim 1 wherein said craft favors straight line travel and includes a forward watertight bulkhead, said craft further comprises:

a pivot axis for said bow rudder lying on said longitudinal mid ship axis with said bow rudder centered on said longitudinal mid ship axis for straight line travel and capable of pivoting both to port and starboard a fixed angular amount relative to said pivot axis for steering said craft.

3. The marine craft in accordance with claim 2 and further comprising:

said forward watertight bulkhead is formed with a vertical hemi-cylindrical column serving as said pivot axis;

said bow rudder having a matching hemi-cylindrical cup for angular swiveling movement within the column of said bulkhead; and a pair of stop shoulders formed in the bulkhead, and located on either side of said column, for limiting an angular amount of pivot movement by said bow rudder.

4. The marine craft of claim 3 wherein the craft is a sail boat having a mainsail mast and a mizzen sail with a mizzen shroud detachable from said deck location, and further comprising:

a moveable mainsail mast base that slides transversely while said craft is moving within fixed limits relative to said longitudinal mid ship axis in order to promote sail changes and to achieve increased speed via an improved draft; and said mizzen sail being tacked by moving the mainsail mast windward and detaching the mizzen shroud so that it and a mainsail may be moved apart a distance sufficient for the mizzen sail to clear the mainsail mast.

5. The sail boat of claim 4 wherein the mainsail has a mainsail boom and further comprising:

the mizzen sail has a mizzen sail boom extending all the way back from its point of attachment to said deck to an aft end of the mainsail boom.

6. The sail boat of claim 5 wherein foot ends of the mizzen boom are attachable to and detachable from a boom foot traveler located on the deck, and further comprising:

said mizzen shroud and mizzen boom, when detached from the deck, are movable forward and upward a sufficient amount to allow the mizzen sail to clear the mainsail mast; and when so moved, the mizzen sail and boom swing leeward.

7. A method of constructing a sail boat having a longitudinal mid ship axis along a monohull from bow to stern for said boat, a straight deep draft keel, a foremost watertight bulkhead and a deck with a symmetrical deck rail on both sides of said boat, said method characterized by comprising the steps of:

fashioning a submersed in-the-water hull having a fully continuous exterior concave or pinched shape, with said shape, in cross section, being a slightly concave submerged V curvature symmetrically running from said keel to a deck rail on both sides of said boat and also running an entire submerged hull length from the bow to the stern;

placing a bow rudder, which has a matching concave V curvature with an area of maximum constriction matching the hull;

installing said bow rudder just forward of a foremost watertight bulkhead for said boat; and collecting water into a water column by said maximum constriction area along a wetted surface of the boat; and dispersing water away from the stern by virtue of converging water columns.

8. The method in accordance with claim 7 wherein the sail boat has a mainsail mast with a moveable mast base and a mizzen sail with a mizzen shroud detachable from a moveable mizzen boom traveler, and further comprising the steps of:

sliding said moveable mainsail mast base transversely windward relative to a mid ship axis for said sail boat;

sliding the moveable mizzen shroud traveler to leeward;

detaching the mizzen shroud from its attachment to said deck; and moving the detached mizzen shroud and the mizzen boom forward a sufficient distance for the mizzen shroud and the mizzen boom to clear the mainsail mast.

9. A method of constructing a sail boat having a longitudinal mid ship axis along a monohull from bow to stern for said boat, a straight deep draft knife edge keel, and a deck with a symmetrical deck rail on both sides of said boat, said method characterized by comprising the steps of:

fashioning a partially submerged hull with a fully continuous exterior concave shape, which, in cross section, is a slightly concave pinched V curvature symmetrically running from said knife edge keel to the deck rail on both sides of said boat and also running an entire submerged hull length from the bow to the stern; and collecting and guiding a water column via said hull shape at points of maximum arc constriction along a wetted submerged surface of the boat.

10. The method in accordance with claim 9 wherein the sail boat has a stern rudder and favors straight line travel; and further comprising the step of:

placing a bow rudder with a pinched V curvature that matches said hull shape at the foremost bow portion of said hull.

11. The method in accordance with claim 9 wherein the sail boat has a moveable mainsail mast base and a mizzen sail and boom with a mizzen shroud detachable from a moveable deck traveler, and further comprising the steps of:

sliding said moveable mainsail mast base transversely windward relative to said longitudinal mid ship axis;

sliding the mizzen shroud to leeward;

detaching the mizzen shroud from its attachment to said deck; and moving the detached mizzen shroud and the mizzen boom forward a sufficient distance for the mizzen shroud and the mizzen boom to clear the mainsail mast.

* * * * *